United States Patent [19]

Röhl-Hager et al.

[11] Patent Number: 5,050,581

[45] Date of Patent: Sep. 24, 1991

[54] PROCESS AND DEVICE FOR DRAWING OFF VAPORS AND FUMES

[76] Inventors: Hannelore Röhl-Hager, Schöenberger Strasse 18, 8400 Regensburg; Georg Koppenwallner, Himmelsstieg 1, 3400 Göttingen, both of Fed. Rep. of Germany

[21] Appl. No.: 528,202

[22] Filed: May 24, 1990

[30] Foreign Application Priority Data

Jun. 9, 1989 [DE] Fed. Rep. of Germany ..... 3918870

[51] Int. Cl.[5] ..... F24C 15/20

[52] U.S. Cl. ..... 126/299 D; 126/299 R

[58] Field of Search ..... 126/299 R, 299 D, 299 F

[56] References Cited

U.S. PATENT DOCUMENTS

| | | | |
|---|---|---|---|
| 3,400,649 | 9/1968 | Jensen | 126/299 D |
| 3,513,766 | 5/1970 | Ahlrich | 126/299 D |
| 4,043,319 | 8/1977 | Jensen | 126/299 D |
| 4,127,106 | 11/1978 | Jensen | 126/299 D |
| 4,153,044 | 5/1979 | Nett | 126/299 D |
| 4,483,316 | 11/1984 | Fritz et al. | 126/299 R |

FOREIGN PATENT DOCUMENTS

| | | | |
|---|---|---|---|
| 2531862 | 2/1977 | Fed. Rep. of Germany | 126/299 R |

*Primary Examiner*—Carroll B. Dority

*Attorney, Agent, or Firm*—Hoffman, Wasson and Gitler

[57] ABSTRACT

In an exhaust hood (5) for cooking places or other kinds of sources of dust or fumes, on the front edge of hood (27) blast nozzle arrangement (26) is provided, which directs blast air (22) in the form of a wall jet approximately horizontally over the underside of hood (28) against filter (17) placed in the rear area of the hood, so that the wall jet draws the flow of fumes and carries it along. In a special embodiment of the exhaust hood, on the underside of the front wall of the hood, a downward directed swirl nozzle (38) is provided, which produces vortex flow (37) which empties into the blast air flow.

8 Claims, 3 Drawing Sheets

Figure 1:
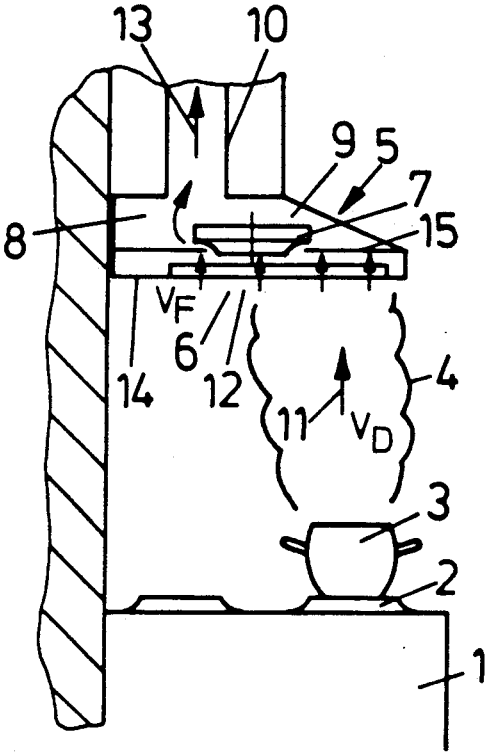
FIG.1 (Prior Art)

FIG.3
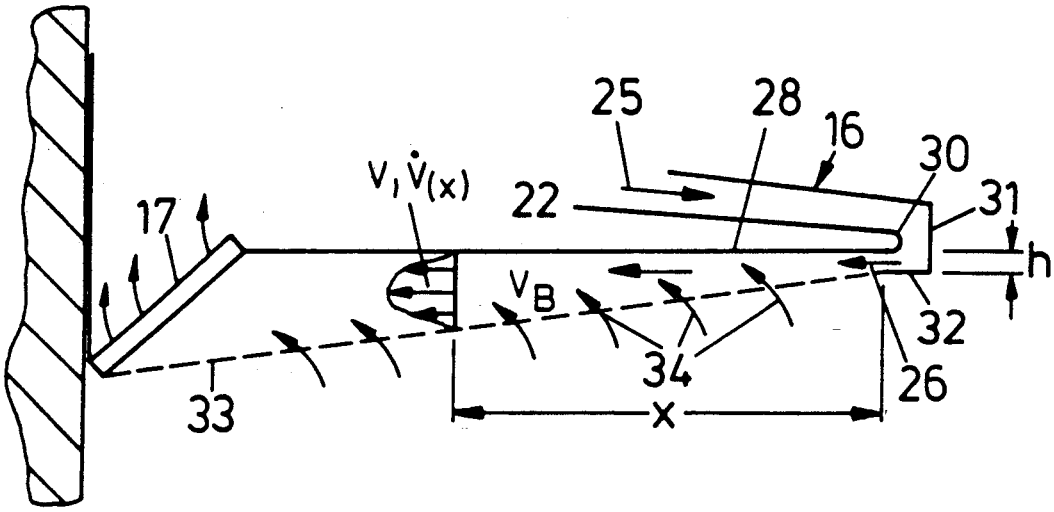
FIG.4
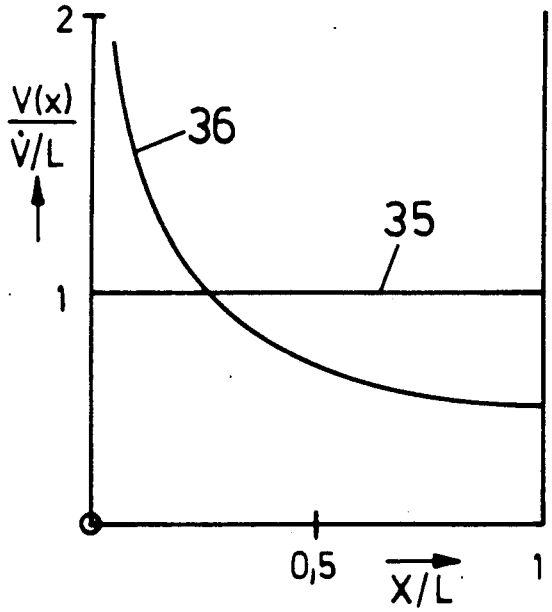
FIG.4a
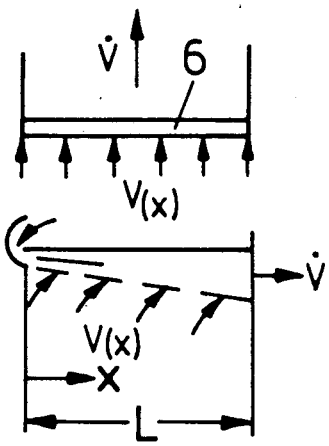
FIG.4b

PROCESS AND DEVICE FOR DRAWING OFF VAPORS AND FUMES

The invention relates to a process and a device for drawing off vapors and fumes which occur on kitchen stoves, in cooking places or fume sources of an industrial kind. Particularly the invention relates to exhaust hoods for kitchen fumes.

To eliminate vapors and fumes, exhaust hoods are placed over the fume sources, which draw off the vapors and fumes by means of fans through a filter surface, and convey the filtered air either back into the work space (circulating air hood) or by way of an exhaust duct into the open (exhaust air hood). Common to all traditional exhaust hoods is to feed the vapor or fumes by a suction jet to the filter surface. Since the cooking vapor is greatly accelerated upward by the thermal lifting forces acting on it and thus develops its own strong dynamics, it is very difficult to catch completely the vapor or fumes by a suction jet, since for this purpose either a hood with a cross-sectional area which is significantly larger than the cooking surface or a fan with extremely high suction power would be needed.

To illustrate the velocities and conditions that prevail on such exhaust hoods the considerations below apply:

Hot water vapor at 100° C. has a density of $\rho_D$, which is about half of the density $\rho_L$ of the ambient air. A thermal lifting force acts on the vapor which seeks to drive it upward with an acceleration $b \approx 9.81$ m/s$^2$. This acceleration is counteracted by the friction with the ambient air at the edge of the flow of fumes, which decelerates the edge areas and thus causes a mushroom shaped vapor cloud flow.

Freely rising water vapor attains, e.g. after a distance of 0.5 m, a theoretical upward velocity of $v_D = 3.1$ m/s. Observation of rising cooking vapors confirms this and shows that steam clouds develop their own strong dynamic with a fluctuating direction of ascent.

The suction flow of usual exhaust hoods is too weak to counteract this inherent dynamic and to conduct the fumes completely to the filter surface. The consideration below shows that in front of the filter surface of normal hoods a back-up of the fumes occurs. Here let us take as a basis that the filter surface $F = 0.2$ m$^2$ and the flow rate V of the fan $= 300$ m$^3$/h. The intake velocity v of the air into the filter thus is:

$$V_F = \frac{V[m^3/h]}{F[m^2] \cdot 3600[s/h]} = \frac{300}{0{,}2 \cdot 3600} = 0{,}42 \text{ m/s}$$

Boiling water vapor after a distance of 0.5 m has an upward velocity of 3.1 m/s. Therefore it must be backed up in front of the filter surface, since it can flow through this filter surface only with the above calculated velocity of 0.42 m/s. With this back-up without a sufficiently large back-up space, a part of the cooking vapor escapes over the edges of the exhaust hood into the kitchen. To prevent this, various kinds of fresh air veils have been suggested which are directed downward from the edge of the hood. Corresponding suggestions can be taken, for example, from the following: DE-OS 22 59 670, 19 63 456, 19 24 345 and 16 04 293.

From DBGM [German Federal Utility Model] 85 34 453 an exhaust hood with an approximately rectangular cross section with a separate feeding pipe and suction pipe is known. The air that gets out of the feed pipe into the feed chamber formed by an inclined separation wall and the vertical side wall is directed by way of a curved flow duct and an outlet opening as a free jet, in other words as a jet without a lateral limit, against the filter installed at an angle on the opposite side of the hood, placed in the hood interior. The level free jet coming out of the outlet opening thus spreads out upward at an angle in a cone shape in the direction of the filter without being conducted and without any edge limitation, and can be diverted by environmental influences, so that a uniform conducting of the flow is not attained, edge jets are not caught by the suction fan and the effectiveness of the hood is reduced.

To prevent escapes of fumes into the kitchen, the power of the fan can be increased, which however normally results in a very high level of noise, or screens that can be swung out can be incorporated on the front edge of the hood, but their effectiveness is relatively limited and they significantly diminish the view to the cooking surface and they get dirty relatively quickly because of steam and grease condensation.

The object of the innovation is to produce a process and a device for drawing off fumes or vapor, so that the flow of fumes rising from the fume source is fully caught in the device, and any escape into the kitchen or the surrounding area is prevented; at the same time the power of the suction fan and thus the noise level is to be kept as low as possible, and the effectiveness of the hood as high as possible.

This object is attained according to the invention with the features of the characterizing clause of claim 1. Further embodiments of the invention are the object of the subclaims.

With the present invention it is thus proposed to blow a horizontal air jet from the front edge of the hood to the filter surface located on the rear end of the hood. This air jet is taken from the fan as blast air, diverted on the front edge of the hood and conducted through a slot on the front edge of the hood along the underside of the hood in the form of a wall jet. This wall jet catches the vertically rising fume flow and feeds it to the filter surface. The wall jet works like an aerodynamic conveyor belt; the velocity of the wall jet is higher than the velocity of the rising cooking fumes, which are not decelerated when they are caught on the underside of the hood. By the use of such a wall jet the air flow is effectively conducted to the filter by the underside of the hood; the wall jet draws only on the free side, in other words ambient air on the underside of the air jet facing the fume source. By the wall the wall jet is securely conducted, it adheres firmly to the wall and can even follow rather large deflections on the wall. Further the wall jet is significantly less sensitive to influences from the environment than a free jet. Finally the wall jet is necessary to produce the vortex because of the interaction with the air jet from the swirl nozzle.

The output of the suction fan placed behind the filter surface is measured so that it conveys at least the amount of air of the wall jet to the filter intake surface. As a result of the suction effect of the jet, the air jet $V_o$ initially blown out increases continuously until reaching the filter surface. The quantity of air blast $V_o$ can either be taken from the suction fan on the pressure side or drawn in by a small additional fan over the filter, or fed to the filter as an additional fan on the front edge of the hood in the form of a pressure blast jet. If the wall jet is produced by a slot nozzle, the most important flow quantities along the jet can be roughly calculated according to the free jet theory, in which:

The volume flow in the jet increases as follows:

$$\frac{V(x)}{V(x=0)} \approx 0{,}58 \cdot \sqrt{x/h}$$

The jet widens with increasing running length and its maximum velocity decreases continuously.

The decrease in this maximum velocity V in the jet is $$v(x)/v(x=0) \approx 2{,}44 \cdot \frac{1}{\sqrt{x/h}}.$$

The width of the jet is $b_s = s \cdot tg\theta$, in which $\theta \approx 14°$. The widening of the jet can be estimated by the angle $\theta$, which defines the edge of the jet approximately, on which the velocity is only 10% of the maximum value ($\theta \approx 14°$).

For the entire wall jet to be caught, the width of the filter surface must be adapted to the jet width. In comparison with a normal suction flow through a filter, in which the suction effect is uniformly distributed over the filter surface, the wall jet offers the advantage that the suction effect is greatest on the blast nozzle located on the front side of the hood.

The velocity of the flow in the filter is distributed uniformly over the entire filter surface, while in the wall jet the flow velocity $v_z$ toward the blast nozzle increases according to $v_z \approx 1/\sqrt{x}$. In particular it is true:

$$v_z(x) = 0{,}58 \cdot v_o \cdot \frac{1}{2} \frac{1}{\sqrt{x/h}}; (x/h > 1).$$

Since the blast jet on the underside of the hood is fed on one side on one wall, the free jet formulas can only be used as a first approximation. Basically a wall jet with only one free jet surface for the flow of fumes is involved. With the formulas given above only a rough first interpretation of the venting and suction geometry is possible. A fine tuning of the ratios is to be performed experimentally using a defined hood.

In conventional hoods that draw off fumes, fumes very frequently escape on the front area of the hood. To prevent such an escape of fumes, mechanical screens, so-called ventilator screens, have been used.

In contrast to these, with the wall jet principle according to this invention an aerodynamic ventilation screen results in the form of a vortex, which occurs on the front edge of the hood from the interaction of the wall jet with an additional weaker free jet or swirl jet. This weaker free jet is produced with the help of a small slot which is designated as a swirl nozzle and stands approximately perpendicular to the blast slot. By the interaction of the two jets, namely the wall jet and the swirl jet, a vortex is produced which is located underneath the front edge of the hood and its direction of rotation points downward and inward from the front edge of the hood. This vortex acts over the edge of the hood, thus catches the fumes which flow past the edge of the hood, and conducts them to the blast jet, which carries them on to the filter surface.

The width $b_w$ of the slot of the swirl nozzle is about a third to a fourth of the width of the blast nozzle. The air of the swirl nozzle is taken from the feed duct before the blast the nozzle, and this duct is designed between the fan and the front limit of the hood. Thus the blast nozzle and the swirl nozzle work with the same overall pressure.

The position of the vortex core can be controlled by the width of the swirl nozzle. If the width $b^w$ of the nozzle is small in relation to the width of the blast nozzle, the core is located very close to the blast jet. If the width of the blast jet nozzle is 6 mm and the width of the swirl nozzle is 2 mm, the primary vortex core is located about 2 cm below the hood. By observations of the flow with smoke or thick cooking fumes it can be shown that the vortex is produced according to the process described and that it catches cooking fumes even outside the hood. The core of the cooking fumes vortex thus lies somewhat lower that the core of the primary air vortex.

In a special embodiment of the invention the hood is fitted with a suction fan, by which about 25% of the air on the pressure side is used for the wall jet. The remaining 75% is carried off into the open air by the exhaust air pipe. The blast air is conducted in a hollow chamber or hollow duct to the front edge of the hood, where it comes out by the blast nozzle and swirl nozzle. The rising fumes are caught by the vortex and the wall jet and transported very quickly to the back filter, where they are caught by the fan with the additional air drawn in.

For flawless effectiveness of the process according to the invention the continuity of the flow at the filter intake is of significance; in other words, the air flow of the wall jet at the filter intake must not be greater than the conveying capacity of the fan, and the flow resistance of the filter is to be taken into consideration. If the blast air jet is too great, a part of the air jet skirts the filter and flows downward along the back wall.

With a vortex at the edge of the hood according to the invention the escape of the fumes outside of the area of the hood is prevented and in addition, cooking fumes which rise outside of the hood from the stove or the source of fumes are caught and fed to the exhaust hood.

With the help of the wall jet because of the high velocity of this jet, the entire rising fumes are caught and fed to the filter. With appropriate design the fumes are not forced through the wall jet, but are carried along by it, so that on the wall side of the jets, in other words the underside of the exhaust hood, even with strong development of fumes at the source of fumes no precipitation of water vapor or grease can be detected. The hood underside and the front side of the hood in contrast to ordinary hoods remain dry and clean. The formation of water vapor, which condenses on the ventilation screen of an ordinary hood when a lot of fumes develop, is completely avoided by the vortex at the edge of the hood. The underside of the hood is constantly exposed to the purified air of the jet and thus becomes dirty much more slowly than in ordinary hoods with suction operation only.

Figure 2:
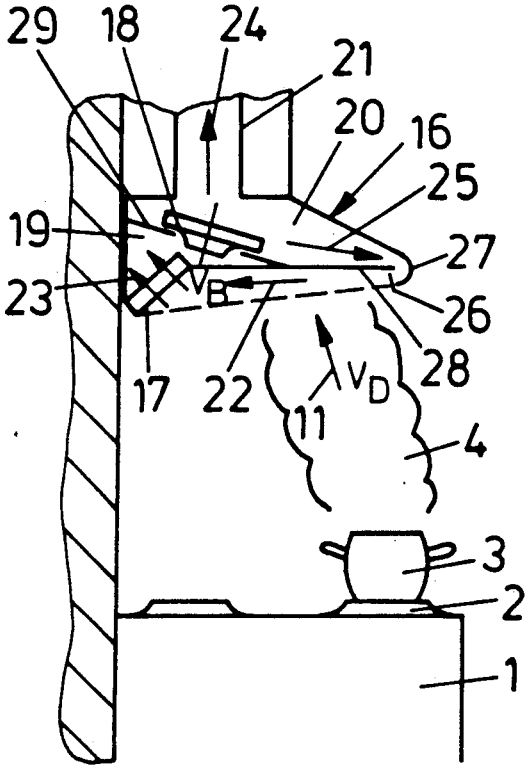

Below the invention is explained in connection with the drawing with examples of embodiments. There are shown in:

FIG. 1 the principle of a known exhaust hood over a source of fumes,

FIG. 2 the principle of the exhaust hood according to the invention with a blast jet which is conducted as a wall jet over a source of fumes, FIG. 3 a detailed representation of the flow of the wall jet according to the invention on the exhaust hood, FIG. 4, a diagrammatic representation of the distribution of the feed flow velocity on the exhaust filter and in the blast jet of the wall jet, FIG. 4*a*, a diagrammatic representation of the suction flow.

FIG. 4*b*, a diagrammatic representation of the blast flow.

Figure 5:
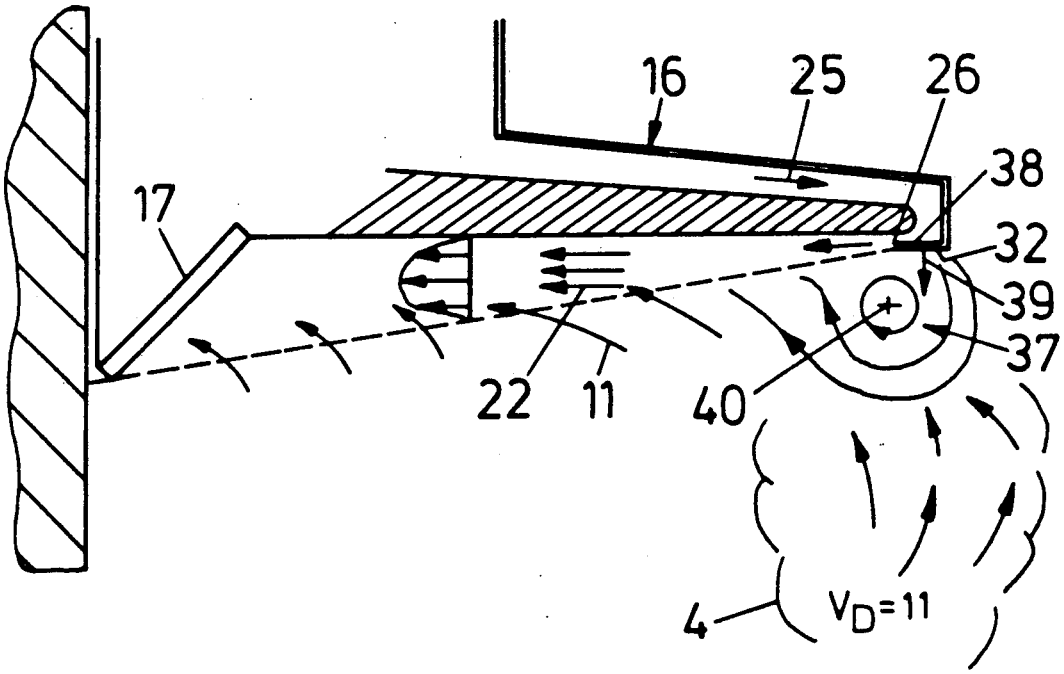
Figure 6:
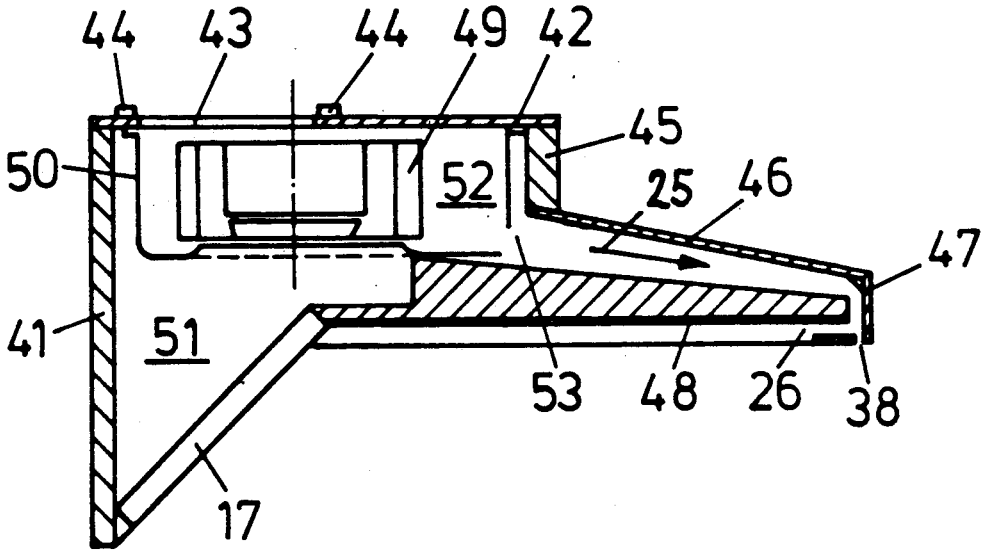

FIG. 5, a further arrangement of the invention according to FIG. 3 with a vortex at the edge of the hood, and FIG. 6, a special embodiment of the exhaust hood according to the invention.

Figure 7:
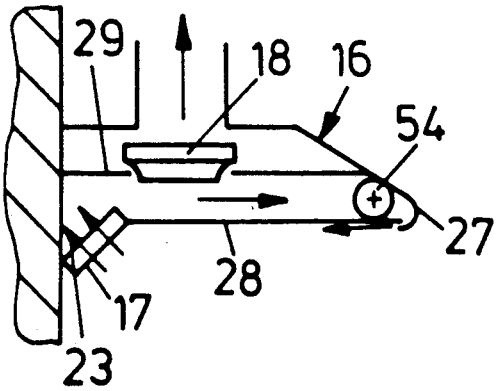

FIG. 7, a further embodiment of the exhaust hood according to the invention.

Figure 8:
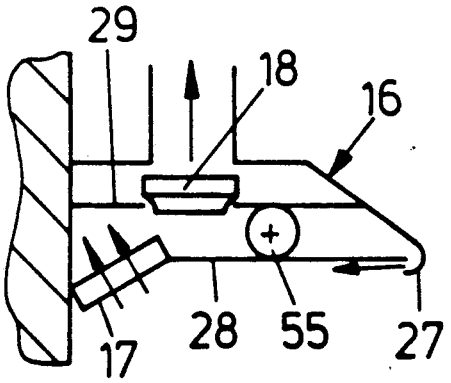

FIG. 8, another embodiment of the exhaust hood according to the invention.

Known exhaust hoods catch the fumes by suction jet. In FIG. 1, stove 1 exhibits hotplate 2 with cooking pot 3 as a fumes source. Flow of fumes 4 runs upward to filter 6 provided in exhaust hood 5, over which fan 7 is placed. The suction space is represented by 8 and the pressure space within the exhaust hood 5 is represented by 9. The filtered air moves from fan 7 through ventilation pipe 10 either into the open air or as purified circulated air into room again. With arrow 11 the velocity of the rising flow of fumes is designated, with 12 the suction flow and with arrow 13 the exhaust air. 14 designates the underside of exhaust hood 5, 15 an intermediate bottom which separates filter 6 from fan 7. The velocity of the flow of fumes 11 ($v_D$) is thus many times greater than the velocity of suction flow 12 ($V_F$).

In catching the fumes with the help of the blast flow according to FIG. 2, stove 1, hotplate 2 and fumes source 3 are represented according to FIG. 1. Exhaust hood 16 exhibits a filter 17, which is placed in the back area of the exhaust hood and installed at an oblique angle between the rear area of the underside of the hood and the back side of the hood, forming a part of the underside of the hood. Fan 18, assigned to filter 17, is placed at an angle. The suction space is designated with 19, the pressure space with 20 and the exhaust air duct with 21. Further the flow of fumes is designated with 11, the wall jet on the underside of the hood with 22, the suction flow with 23, the exhaust air with 24 and the blast air in the hood with 25. Blast nozzle 26 is designed on the front lower end of hood 27. 28 designates the underside of the hood, which is the wall limiting the flow of wall jet 22, and 29 designates the intermediate bottom.

Catching of the fumes with the help of the flow of the wall jet is represented in FIG. 3 in greater detail. Here inside exhaust hood 16 intermediate bottom 28 is designed with a rounded front end 30; exhaust hood 16 exhibits on the front end, face 31 which runs approximately vertically and adjoining lower limit 32 which runs approximately horizontally. Elements 30, 31 and 32 form the deflection duct for blast air flow 25 within the hood and blast nozzle 26, from which wall jet 22 comes out, and its lower limit is designated with 33. With 34 partial flows of suction flow 11 are represented by arrows. Further in FIG. 3 the velocity distribution of wall jet 22 is indicated in the form of volume flow V.

FIG. 4 shows the distribution of the feed flow velocity in the filter, and a) shows the suction flow and b) the blast flow. In the case of the pure suction flow in known exhaust hoods the suction effect is uniformly distributed over the whole surface of the filter. Curve 35 is a straight line with the value $v(x)/V/L=1$. In the exhaust hood working with blast flow the suction effect is greatest at the exhaust place on the front side of the hood and decreases according to curve 36 with increasing length ratio x/L according to curve 36. The average feed flow V/L is thus the same in both cases.

In the embodiment according to FIG. 5, to support catching of fumes with blast flow a vortex at the edge of the hood in the front area of hood is formed, which is designated with 37. Underside 32 of blast nozzle 26 exhibits for this purpose a slot 38, through which part 39 of blast air 25 which comes out of hood 16 approximately vertically downward, while the greater part is directed in the form of wall jet 22 against filter 17. Jet 39 coming out of swirl nozzle 32 forms a vortex together with wall jet 22, whose center 40 is formed just under hood 16; around this vortex core 40 vortex flow 37 is formed, which is directed in the viewing direction indicated in clockwise direction and introduced into wall jet 22 and then together with this jet is moved on to filter 17. This vortex catches rising fumes 4 even outside the hood and feeds them to the blast jet. The width of the slot of swirl nozzle 38 is a fraction of the width of the slot of the blast nozzle, approximately one third to one fourth. The position of vortex core 40 can be controlled by the width of the swirl nozzle. Preferably the nozzle opening of swirl nozzle 38 can be designed to be adjustable, so that the ratio of the width of the slot of the swirl nozzle to the blast nozzle is variable.

FIG. 6 shows a practical embodiment of an exhaust hood with a wall jet and vortex at the edge of the hood. The hood consists of back wall 41, cover wall 42 with recess 43 and flange 44 for the exhaust duct, approximately vertically placed partial front wall 45, inclined wall 46 extending forward from wall 45, approximately vertical wall 47 representing the front lower limit of the hood, bottom wall 48 and an oblique wall running between bottom wall 48 and back wall 41 and receiving filter 17 as well as side walls which are not represented. In the interior of the exhaust hood, fan 49 is separated from the filter area by intermediate wall 50, so that between intermediate wall 50 and the filter a suction space 51 is formed and above the intermediate wall pressure space 52 is formed. Intermediate wall 50 is thus designed as the spiral housing surrounding fan 49, which has an opening 53 to the front side of the hood, through which blast air 25 can reach the blast nozzle and the swirl nozzle. The blast air thus flows through an air duct made through the hood housing, and its shape is designed so that the blast jet reaches the blast nozzle or the swirl nozzle in a defined manner.

FIG. 7 discloses a further embodiment of the instant invention wherein a separate fan 54 is provided on the front hood edge 27. In this embodiment, the separate fan 54 produces the wall jet 22 and directs it against the filter 17.

Another embodiment is shown in FIG. 8. This embodiment includes a separate fan 55 in the area of the filter 17. This separate fan 55 produces the blast air of the wall jet.

The embodiment shown can be changed into a circulating air hood in a simple way. For this purpose, with the help of a change-over damper, not represented, the exhaust air (as is usual in other reversible hoods) can be funneled into the kitchen.

We claim:

1. An exhaust hood for installation over a cooking place, or a corresponding source of dust or fumes, comprising:

a hood including a suction fan, a filter, air ducts, and a lower hood edge blast nozzle arrangement at a forward end of said hood, wherein said lower hood edge blast nozzle arrangement is shaped to direct blast air (22) under said hood and against said filter that is positioned in a rear area of the hood; and, said blast air nozzle arrangement is shaped to provide a wall jet of air directed horizontally adjacent and along a horizontal underside of said hood for drawing off fumes (4) and carry said fumes along said horizontal underside (28) of said hood, such that said wall jet is limited in its upward movement by said horizontal underside and further directs air slightly downward from said blast nozzle (26) so that a lower borderline of said wall jet extends toward a lower edge of said filter (17);

said filter in the rear hood area is attached to said horizontal underside (28) and extends obliquely from said horizontal underside (28) down toward the rear of the hood.

2. Exhaust hood according to claim 1, including means wherein blast air (22) is removed from said fan (18) on its pressure side (52) in the form of a bleeding flow (25), conducted in a flow duct formed by an upper side (46) of the hood and wall forming said horizontal underside of the hood, is diverted in the area of blast nozzle (26) and is conducted as wall jet (22) out of blast nozzle (26).

3. Exhaust hood according to claim 1, wherein on front hood edge (27) a separate fan is provided, which produces wall jet (22) and directs it against filter (17).

4. Exhaust hood according to claim 1, wherein said fan is installed in the area of the filter (17).

5. Exhaust hood according to claim 1, wherein said blast nozzle arrangement (26) is a slot in a housing forming said hood.

6. Exhaust hood according to claim 1, including means forming a slot shaped downwardly directed nozzle (38) on the forward end of said hood and adjacent said blast nozzle arrangement and the jet of nozzle (38) and the wall jet produces an eddy flow, which acts as an aerodynamic vapor screen.

7. Exhaust hood according to claim 6, wherein said eddy flow runs downward from the front edge of the hood, and combines with the air flow (22) of the wall jet in the direction of filter (17).

8. Exhaust hood according to claim 1, including means wherein the velocity $V_B$ of said wall jet (22) is greater than the velocity $V_D$ of the rising fumes.

* * * * *